United States Patent [19]

Olson

[11] 4,304,986

[45] Dec. 8, 1981

[54] ELECTRIC HEATING APPARATUS FOR FOUNDRY LADLE

[75] Inventor: William E. Olson, Sherwood, Oreg.

[73] Assignee: ESCO Corporation, Portland, Oreg.

[21] Appl. No.: 170,778

[22] Filed: Jul. 21, 1980

[51] Int. Cl.[3] ..... H05B 3/06

[52] U.S. Cl. ..... 219/523; 219/421; 219/426; 219/437; 219/537; 222/146 HE

[58] Field of Search ..... 219/10.49, 421, 422, 219/423, 425, 426, 437, 523, 537, 536, 415, 418, 420, 433, 434, 521; 13/25; 222/146 HE

[56] References Cited

U.S. PATENT DOCUMENTS

| | | | |
|---|---|---|---|
| 2,972,037 | 2/1961 | Taves | 219/523 X |
| 3,148,272 | 9/1964 | Aitken et al. | 219/523 X |
| 3,293,412 | 12/1966 | Profitt et al. | 219/421 |
| 3,502,847 | 3/1970 | Heide | 219/426 |
| 3,673,385 | 6/1972 | Drugmand et al. | 219/523 X |
| 4,090,054 | 5/1978 | Heine et al. | 219/10.49 R |
| 4,227,069 | 10/1980 | Gardner et al. | 219/421 |

*Primary Examiner*—Volodymyr Y. Mayewsky
*Attorney, Agent, or Firm*—Tilton, Fallon, Lungmus & Chestnut

[57] ABSTRACT

An electric heater for a foundry ladle wherein a frame is equipped with a descending electric heater operated and controlled to preserve the integrity of the electric heater.

22 Claims, 8 Drawing Figures

FIG. 1
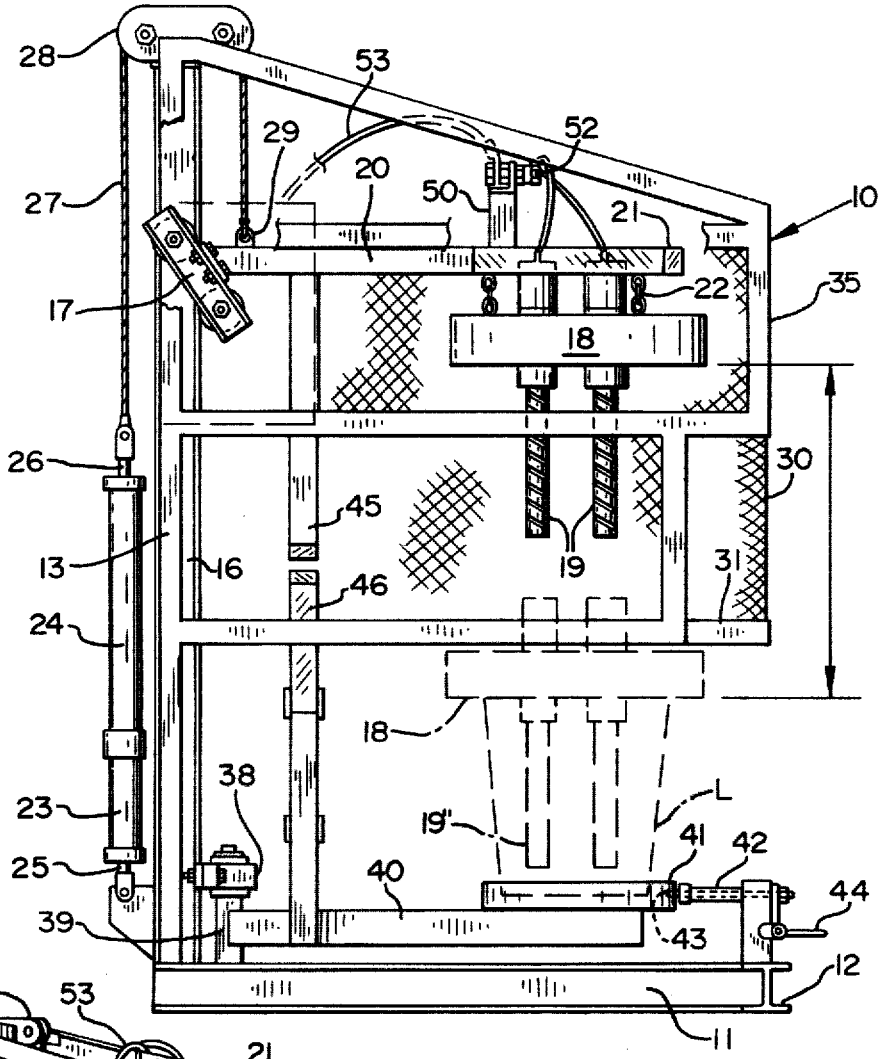
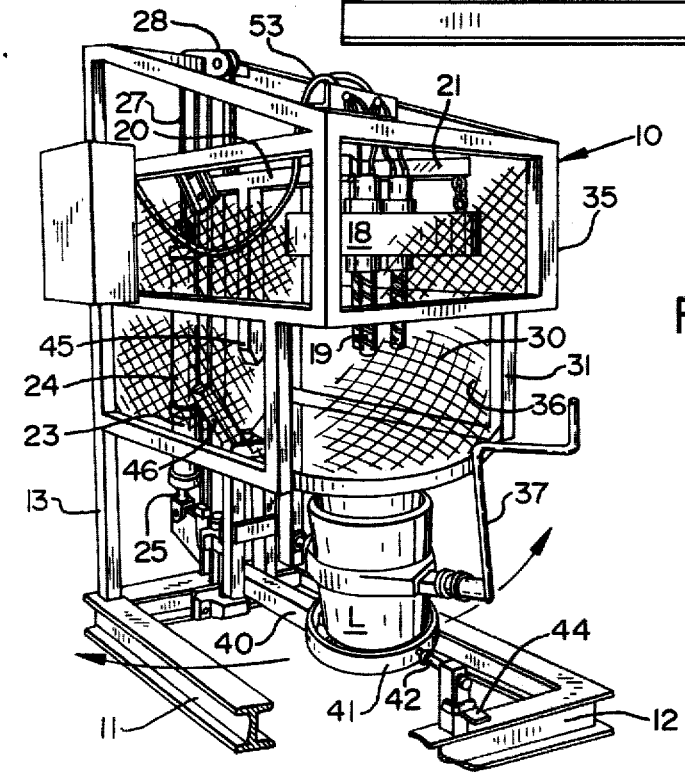
FIG. 2

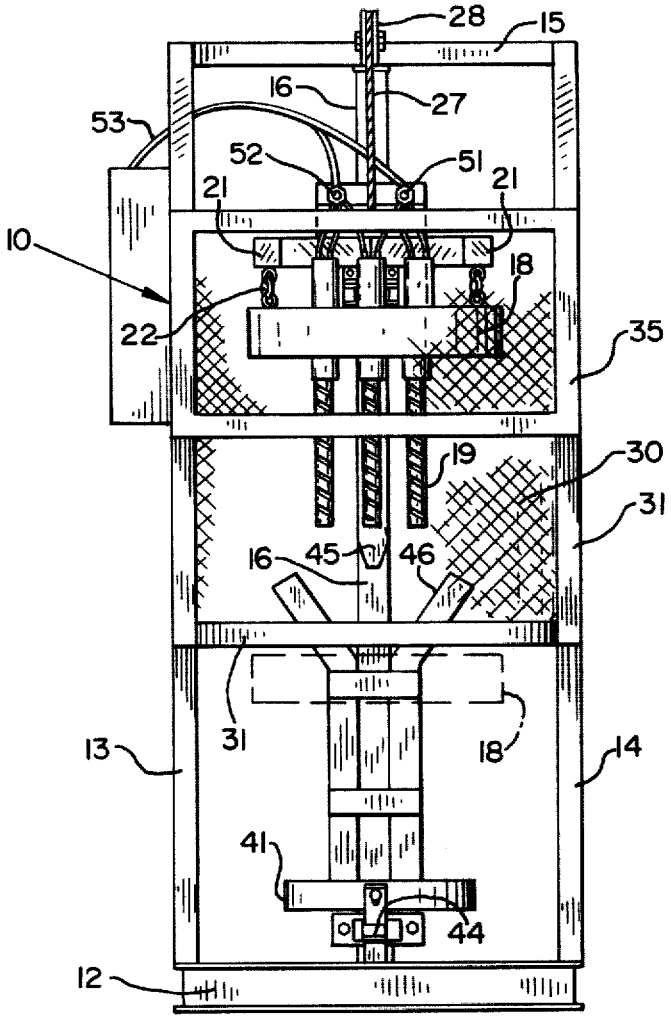
FIG. 3
FIG. 4
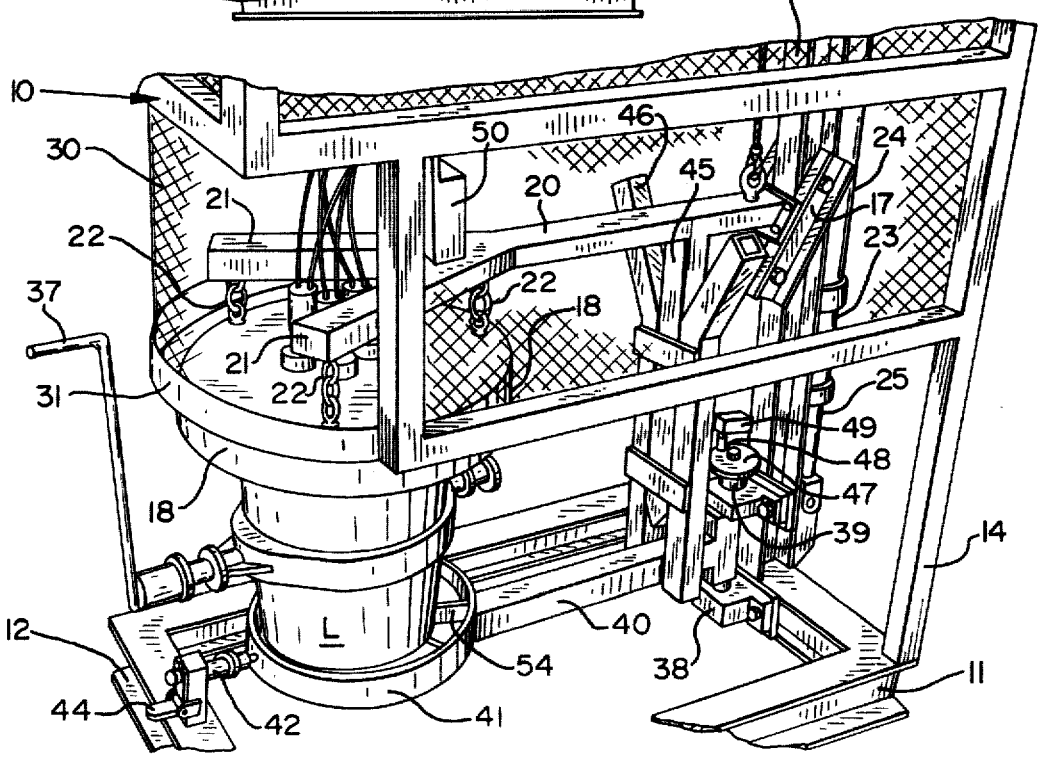

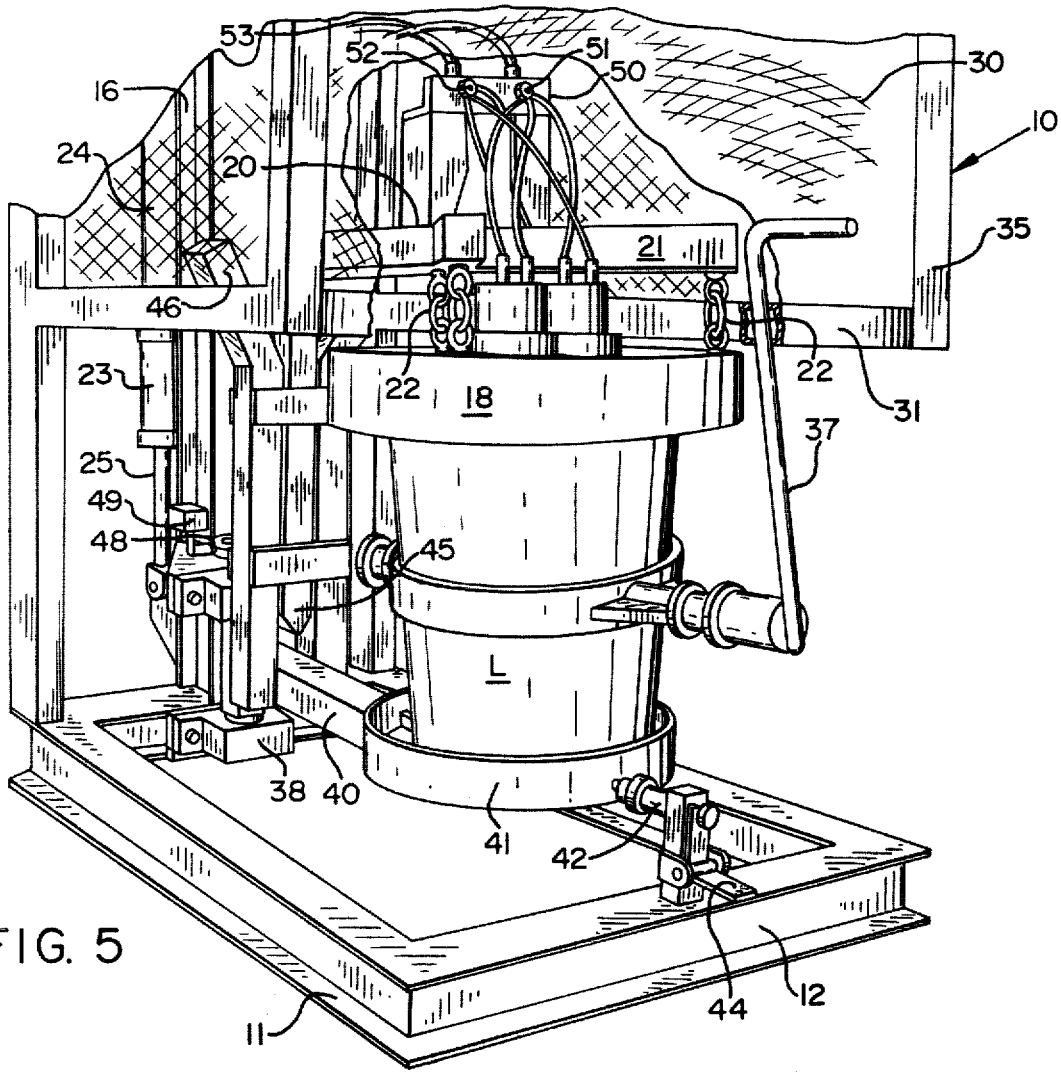
FIG. 5
FIG. 6
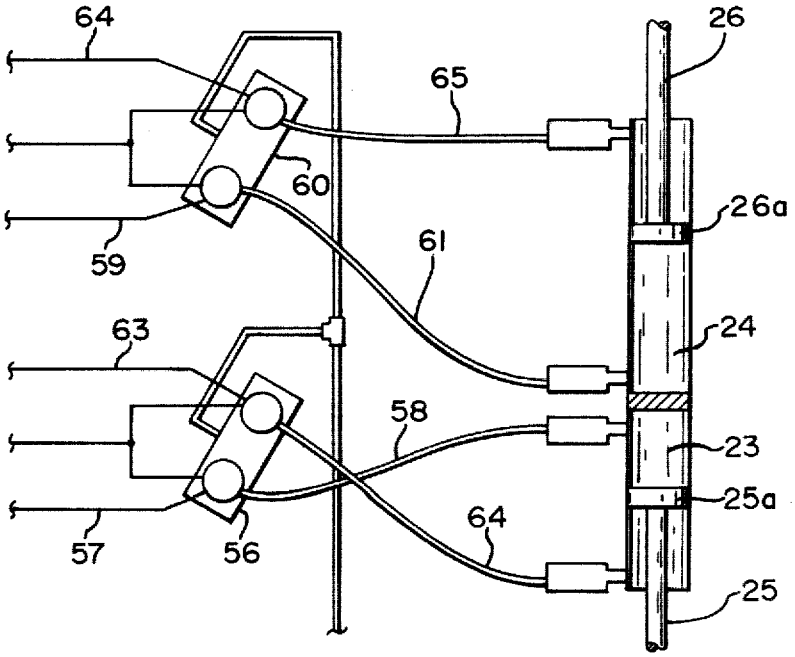

ELECTRIC HEATING APPARATUS FOR FOUNDRY LADLE

BACKGROUND AND SUMMARY OF INVENTION

This invention relates to an electric heater for a foundry ladle and, more particularly, to apparatus for operating and controlling the same so as to protect the integrity of the electric heating means constituting the electric heater.

It is common practice in the foundry industry to preheat ladles prior to having the molten metal introduced therein. This preserves the ladle lining against possible fracture and also conserves the metal itself against premature solidification. The practice over the years has been to heat ladles by an open gas flame which not only has been wasteful of energy but dangerous to operating personnel. It was therefore desirable to provide an electrically powered heater for this purpose and one approach in the prior art is found in U.S. Pat. No. 4,090,054.

The mechanical arrangement and construction of the '054 patent produced certain disadvantages, notably in the failure of the insulation separating the electrical heaters from the transformer atop the lid which resulted in premature failure and breakdown of the apparatus. Also, the apparatus of the '054 patent was not particularly suited for use of silicon carbide electrical heaters which are preferred in the foundry industry because of their reliability and long life.

In particular, the silicon carbide electrical heaters although possessing the foregoing advantages, are characterized by the disadvantage of being extremely fragile. For example, an electric heater which has been in use for 1000 hours showed no signs of wear but when accidentially bumped against a rigid object, shattered into small pieces.

The fragility of the silicon carbide type of electric heater is not only affected by the handling thereof but also by the environment. For example, such electrical heaters are extremely sensitive to thermal shock—a quick cooling can cause the electrodes to shatter.

The instant invention utilizes the advantages of the silicon carbide type electric heater and, by providing a structural arrangement and operation of the associated mechanical and electrical control apparatus, avoids the disadvantages also outlined above. According to the invention, a frame provides a pedestal on which the ladle to be heated is placed. The frame also is equipped with a vertical post on which a carriage travels for lowering and raising the electric heaters under certain electrical and mechanical safeguards which avoid both mechanical and thermal shock. Other objects and advantages of the invention may be seen in the details of construction and operation as set down in the ensuing specification.

DETAILED DESCRIPTION

The invention is described in conjunction with an illustrative embodiment in the accompanying drawing, in which:

FIG. 1 is a side elevational view of the inventive apparatus;

FIG. 2 is a fragmentary perspective view of the apparatus of FIG. 1;

FIG. 3 is a front elevational view;

FIG. 4 is another fragmentary perspective view taken essentially from a right angle to that of FIG. 2;

FIG. 5 is a view similar to FIG. 4 but showing the lid structure in closed relationship relative to the ladle;

FIG. 6 is a schematic piping diagram of the mechanism for raising and lowering the lid structure;

Basic Frame

Figure 7:
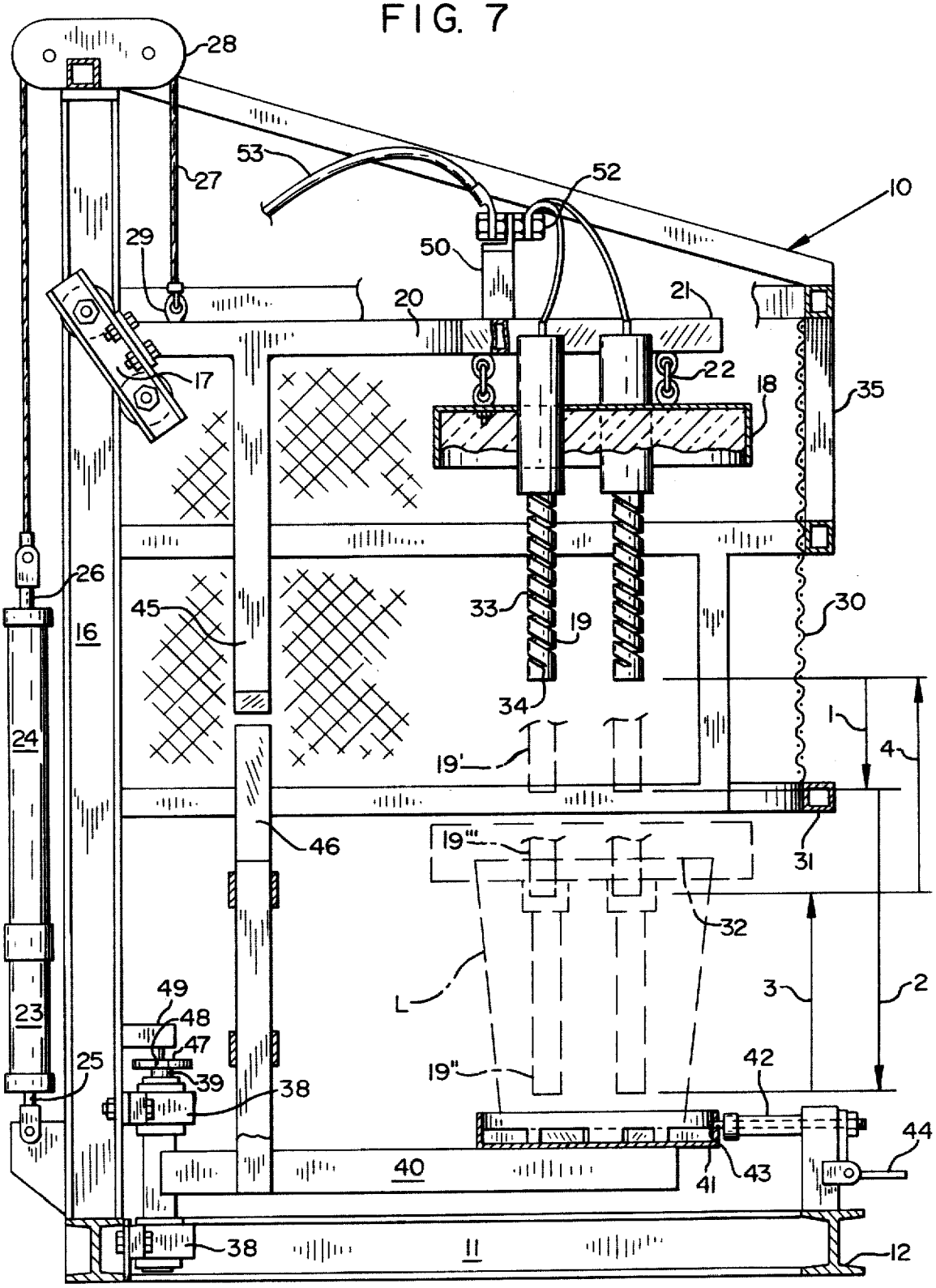
FIG. 7 is an enlarged side elevational view of the apparatus.

In the illustration given and with reference first to FIG. 1, the numeral 10 designates generally a frame which has a pedestal constructed of H beams so as to provide a rigid support for various elements of superstructure to be described hereinafter. The H-beams 11, 12 (see also FIG. 2) are arranged in rectangular form and at one end are equipped with vertical framing members 13 and 14 suitably connected by an upper cross tie 15 (see FIG. 3). Located intermediate the vertical framing members 13 and 14 is a post or pillar 16 which constitutes a track or way for a carriage 17 (see FIG. 1) employed to vertically travel a lid 18. The lid 18 in turn carries the electric heater means in the form of a plurality of depending electrical heaters 19.

Lid Elevator

For the purpose of raising and lowering the heater, the carriage 17 is equipped with a horizontally extending arm 19 (see particularly FIG. 4) which is equipped at the end thereof remote from the carriage 17 with diverging arms 21. Chains 22 are connected to the diverging arms 21 and the main arm 20 for supporting the lid 18. The chains provide an adjustable or adapting function so that the lid can conform to a slightly non-aligned lip on the ladle L. Thus, as the carriage 17 moves up and down on the post 16, the electrical heaters move correspondingly relative to the ladle L—compare the solid and dotted line positions in FIG. 1.

Mounted adjacent the base of the post 16 are a pair of pneumatic cylinders 23 and 24 equipped with the usual piston rods 25 and 26 (see the left hand portion of FIG. 1). Connected to the upper end of the piston rod 26 is a cable 27 which is reeved over pulley arrangement 28 at the upper end of the post 16 and which thereafter runs downwardly for connection to the arm 20 as at 29. Thus, extending the piston rods 25 and 26 from the FIG. 1 condition serves to lower the lid 18 by causing the carriage 17 to ride down the post 16.

Sequence of Lid Elevator Movement

Reference is now made to FIG. 7 and when the piston rods 25 and 26 are in the fully retracted position as illustrated, the electrical heaters 19 are in their uppermost condition—as illustrated in solid line. To initiate a cycle of operation, the piston rod 25 of the smaller of the two axially aligned, end connected cylinders 23 and 24, is extended. This results in the electrical heaters 19 moving a short distance designated 1 in the right hand central portion of FIG. 1. This brings the electrical heaters to the position 19' and it is seen from FIG. 7 that in this position, the electrical heaters 19' are still shielded or protected by the screen 30 and frame 31 therefor. The screen 30 and frame 31 are also seen particularly clearly in the perspective view of FIG. 2. Thus, it is possible to relocate the ladle L to a position wherein there will be no possible interference with the electrical heaters 19 as they descend further.

The framework 31 is rigid so as to prevent any inadvertent bumping or other contact with the fragile electrical heaters 19 while the screening 30 permits ready visual ascertainment of the position or location of the electrical heaters 19 while they are in the position 19'.

Next in the operation of the given heating cycle, the piston rod 26 of the cylinder 24 is extended so as to lower the lid 18 (and therefore the electrical heaters 19) to the position designated 19'' in FIG. 7. The movement is indicated schematically by the arrow marked 2 in the right hand portion of FIG. 7. In this position, the electrical heaters heat the ladle L for a time and at a temperature determined by the control circuitry to be described hereinafter.

When ladle removal is indicated, the piston rod 25 of the cylinder 23, i.e., the smaller of the two cylinders, is retracted so as to raise the lid and electrical heaters a distance corresponding to that marked 3 in the right hand portion of FIG. 7. At this stage, the electrical heaters are in the position designated 19''' and it will be seen that the bottom portion of each electric heater is still partially received within the ladle L, i.e., below the lip 32 of the ladle. This permits the electrical heaters 19 to cool while the bottom portions are still effectively shrouded within the ladle L and avoids thermal shock which could crack the electrical heaters. The preferred form of the electric heater is seen in FIG. 7 where the cylindrical form is equipped with a spiral groove 33 terminating adjacent to but spaced from the bottom to provide a continuous cylindrical portion as at 34. This cylindrical portion 34 is especially susceptible to thermal shock and is protected when the electric heater is in the position 19''' for cooling.

Lastly, the piston rod 26 of the cylinder 24 is retracted so as to move the electrical heaters 19 upwardly for a distance designated 4 in the right hand portion of FIG. 7.

Protective Screening

The protective screening elements 30 and 31 previously referred to are provided as a superstructure supported by the vertical framing members 13, 14 and the horizontal tie member 15. As can be appreciated particularly from FIG. 2, the protective screening includes an upper section 35 which is generally box-shaped and the lower section which has an arcuate side as at 36. The upper section 35 may also have an arcuate front section, if desired. However, the lower arcuate forward section 36 permits movement of the handle 37 so as to swing the ladle L out of the frame 10 and onto a track or other means for moving the ladle to a pouring site.

Ladle Base

Referring to the lower left hand portion of FIG. 7, it will be seen that bearings 38 are bolted to the post 16. Rotatably supported within the bearings 38 is a vertical post 39 which has rigidly fixed thereto a beam member 40 (see also FIG. 4). Carried by the beam member 40 is a base 41 which supports the ladle L. When the lid 18 (and therefore the electrodes 19) are retracted and the latch 42 disengaged, the handle 37 can be grasped to swing the ladle L and the base 41 horizontally to one side or the other.

The latch 42 has a spring-loaded detent as at 43 which can be disengaged from a mating opening in the base 41 by stepping on the foot pedal lever 44.

Further Protective Devices

Referring now to FIG. 4, it will be seen that the art 20 is equipped with a depending spear 45 which, when the lid 18 is lowered, is received within a V-shaped crotch or socket 46 carried by the beam member 40. Thus, there can be no relative movement between the lip 18 and the ladle L. More particularly, should the latch 42 be disengaged and the ladle L be attempted to be swung laterally while the lid 18 is in a lowered position, the spear 45 by engagement with the V-shaped socket 46 prevents any substantial movement, i.e., within the tolerance afforded for the carriage 17 to ride on the post 16. Conversely, the V-shape of the socket 46 insures that the spear 45 will locate the arm 20 in the proper position relative to the ladle L.

Still referring to FIG. 4, the numeral 47 designates a cam which is fixed to the top of the vertical shaft 39. The cam has a notch as at 48 which receives the cam follower of an actuator on the limit switch 49 (also carried by the post 16). When the limit switch is actuated by having the notch 48 properly aligned, the control circuit is actuated as will be explained hereinafter relative to FIG. 8.

Electrical Connections

Reference is now made to FIG. 5 and in the upper central portion thereof, it will be seen that a generally U-shaped bracket 50 is carried by the arm 20 (see also FIG. 4). The bracket 50 serves as a terminal block for the electrical connections to the electrical heaters 19. Each electric heater has a pair of leads (see the upper portion of FIG. 3) one of which goes to one terminal 51 and the other to a second terminal 52. In turn, each of the terminals 51, 52 is powered from a supply lead 53. By providing the terminal block or bracket 50, it is possible to utilize interchangeable electrical heaters 19 because the various leads are approximately all the same length and easily connected and disconnected.

Operation of Mechanical Elements

A sequence is started with the ladle heater in the stand-by position (heating means raised to its uppermost position) and no ladle on the stand. Thereafter, a ladle is placed on the base 41. More particularly, the ladle L is placed on the radially extending, upstanding ribs 54 (see FIG. 4) so as to minimize heat transfer. Thereafter, the beam member 40 is swung horizontally until the detent 43 latches with the base 41 and the ladle is on the base 41 directly below the lid 18. Thereafter, the "down" button 55 (see FIG. 8) is pushed. This is located on a control console (not shown) and which is advantageously remote from the frame 10, being only electrically coupled thereto.

Thereafter, the lid 18 will descend slightly less than halfway, depending upon the relationship of the lengths of the cylinders 23 and 24. The cylinders are represented schematically in FIG. 6 along with a wiring and piping arrangement. In FIG. 6, the numeral 56 designates a solenoid valve associated with the cylinder 23. An electrical signal along the line 57 positions the solenoid to deliver fluid pressure through the line 58 to the upper portion of cylinder 23 and thereby force the piston **25*a* downwardly to extend the piston rod 25. This results in the lowering of the electrical heaters to the position designated 19' in FIG. 7. This pause allows a final check to see that there will be no interference between the ladle L and the electrical heaters 19**.

Pressing the "down" button 55 a second time delivers a signal along the line 59 to the solenoid 60 (still referring to FIG. 6). This causes pressure fluid to flow in the conduit 61 so as to elevate the piston 26*a* in the cylinder 24 and extend the piston rod 26 thereof. This results in the electrical heaters 19 descending the rest of the way until the lid 18 is in contact with the top or lid of the ladle L and the electrical heaters 19 are fully within the ladle cavity.

Thereafter the heat control is energized and the heating of the ladle is controlled by a thermocouple adjacent the heating elements. When the proper temperature has been attained and the ladle is ready for use, the "up" button 62 (see FIG. 8) is pushed.

This delivers a signal along the line 63 (FIG. 6) to the solenoid 56 so as to deliver pressure fluid through the conduit 64—thereby raising the piston 25*a* and retracting the piston rod 25. This causes the lid to rise until the electrodes are almost clear of the hot ladle. The lid pauses in this position to minimize thermal shock to the heating elements before proceeding the rest of the way, i.e., upwardly to initial position from the intermediate position 19'''. Thereafter, a signal is delivered along the line 64 to the solenoid 60 so as to pressure the conduit 65 and retract the piston rod 26.

When the lid has been raised to its uppermost position, the spear 45 is disengaged from the V-shaped socket 46 and upon disengagement of the latch 42, the base 41 can be swung outwardly so as to remove the ladle L therefrom.

A number of advantages acrue from the foregoing structure. Through the use of the various safeguards, the electrical heaters are protected from accidential contact with the ladle L. The two stage raising system allows cooling of the electrical heaters to prevent thermal cracking. None of the controls are in the heat zone. For example, the commercial counterpart of the previously mentioned '054 patent has a transformer mounted atop the lid. Even with superior material, the lids wear and the insulation breaks down so that at an unexpected time later, the insulations may fail and the unit ruined. Also, locating the controls in the area of the heater requires cooling thereof which complicates the organization of the apparatus. In contrast, according to the invention, the weight on the ceramic fiber lid is at a minimum. The only thing on the lid is the lid itself and the ceramics and the weight of the elements. Because of this, no cooling water is needed on the power leads or any transformer.

The inventive arrangement is such that there is little danger of overturning as the system is built on a broad base and is prevented from overturning or otherwise shifting by the weight of the ladle itself.

Operation of Electrical Elements

Figure 8:
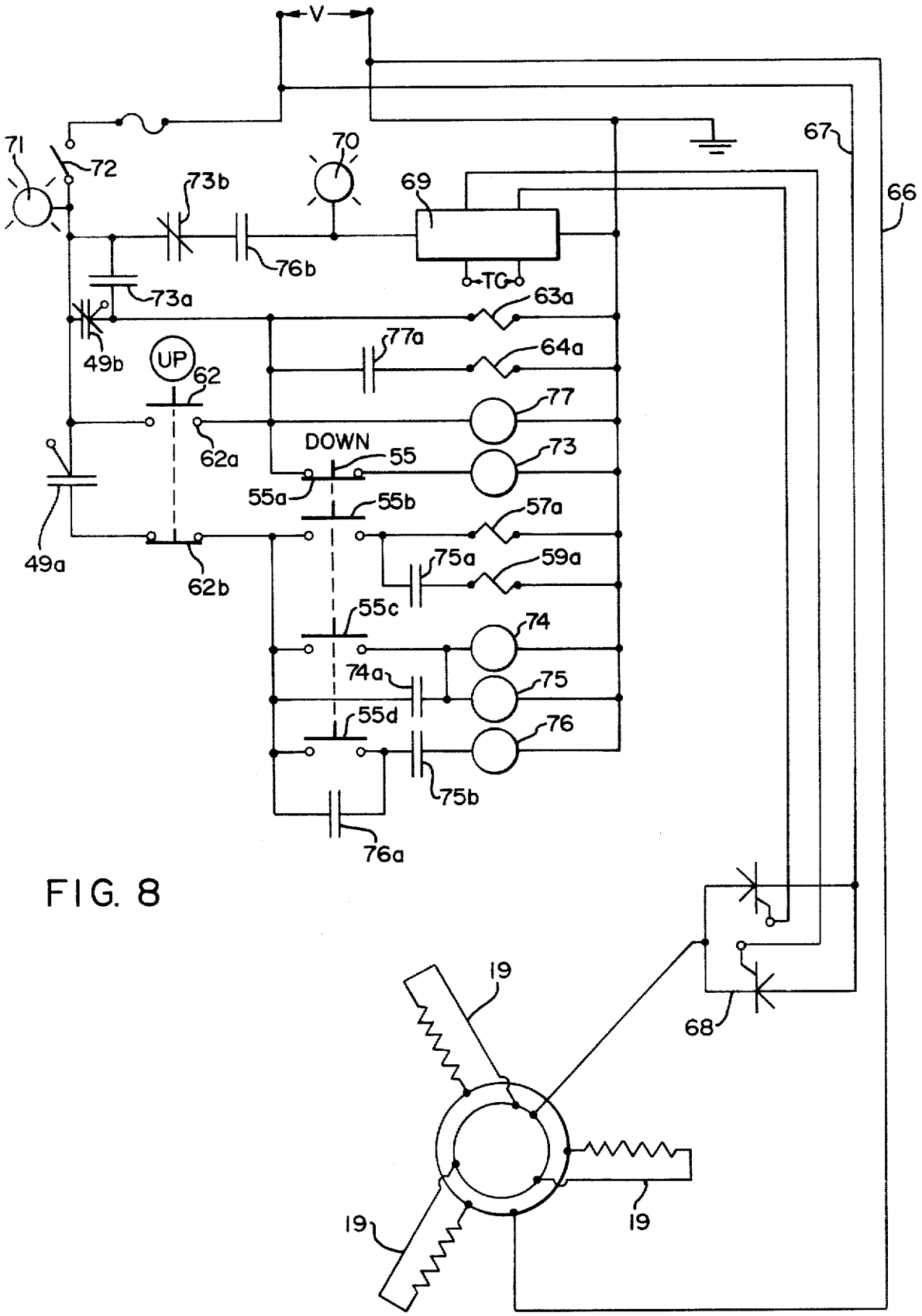
FIG. 8 is a schematic wiring diagram featuring the controls associated with the inventive apparatus.

Reference is now made to FIG. 8 and the electrical heaters 19 are represented schematically as heating elements in the lower central part of the drawing. Electrical power for the elements is provided from a line source V via one line 66 which is electrically connected directly to the elements 19 and through a second line 67 which is delivered to a silicon controlled rectifier 68. Interconnected with the rectifier 68 is the heater control 69 which is responsive to the thermocouple TC. When current is delivered to the heater control, the lamp 70 is energized. A similar light 71 is energized when the power is on via the closing of the power switch 72. However, before power is delivered to the heater control 69, a sequence of activities must first take place—being initiated by actuation of the "down" button 55.

The down button has associated therewith four sets of contacts 55*a*, 55*b*, 55*c* and 55*d*. Of these only contacts 55*a* are normally closed—as illustrated in the central portion of FIG. 8.

Momentary depression of the spring-loaded "down" pushbutton 55 open the contacts 55*a* thereby removing power from the coil of relay 73. Simultaneously, the depression of down pushbutton 55 closes the contacts 55*b* to energize the first down air valve via line 57 (see FIG. 6) to actuate the coil 57*a*.

With the closing of contacts 55*c*, the coil of relay 74 is energized along with that of the timing relay 75. Relay 74 closes the contacts 74*a* to seal in relays 74 and 75. The depression of the down pushbutton also closes the contacts 55*d*.

Because of the energization coil 57*a*, the resistance elements 19 travel downwardly and stop just above the lip of the ladle L—depending upon the extent of travel of the piston rod 25 of cylinder 23.

At this juncture, the operator inspects the ladle to make sure that there are no obstructions or interfere with further downward travel. The operator thereupon presses the "down" pushbutton a second time. This is only effective to continue the operation after the timing relay contact 75*a* has been closed to permit delivery of current to the second down coil 59*a*.

The closing of contacts 55*d* delivers current to the coil of relay 76 because the contacts 75*b* of the timing relay 75 are now closed. This relay seals itself in through the contacts 76*a* and closes the contacts 76*b* to deliver current to the controller 69. The temperature regulated by the controller 69 is responsive to the signal delivered by the thermocouple TC within the ladle and the ladle can be maintained at a predetermined temperature for as long a period as needed before next usage.

When need is indicated for the ladle being heated, the instantaneous up pushbutton 62 is depressed. This closes the contacts 62*a* and opens the contacts 62*b*. Opening of the contacts 62*b* removes power from the relay 76 so as to open the contacts 76*a* and 76*b*.

The closing of the contacts 62*a* energizes the coil 63*a* of the first up solenoid. Additionally, a timing relay 77 is energized along with the relay 73. Relay 73 is sealed in through the closing of contacts 73*a* and the opening of contacts 73*b* removes power from the temperature controller 69.

The raising of the resistance elements 19 is stopped at the 19''' position for a cooling period until the timing relay 77 takes over to close the contacts 77*a* and thereby deliver power to the second up solenoid valve coil 64*a*. At this point, the heated ladle L is ready to be removed from the apparatus.

The limit switch 49 previously referred to controls a pair of contacts 49*a* and 49*b* located in the upper left hand portion of FIG. 8. The contacts 49*a* must be closed to allow down movement of the heating elements. If the ladle base 41 is off index, contacts 49*b* are closed and the up circuit is energized.

While in the foregoing specification, a detailed description of an embodiment of the invention has been set down for the purpose of illustration, many variations in the details hereingiven may be made by those skilled in the art without departing from the spirit and scope of the invention.

I claim:

1. Electric heating apparatus for a ladle comprising a frame providing a base for a ladle to be preheated and a vertically extending post positioned adjacent said base, a carriage on said post carrying an arm horizontally extending therefrom, a lid on said arm spaced from said carriage and adapted to close a ladle on said base, said lid being equipped with electric heating means adapted to depend inside said ladle when said lid is in closing relationship therewith, electric power means coupled to said electric heating means to energize the same, means on said frame for selectively traveling said lid between an upper position above said ladle and a lower position in closing relation with said ladle and for stopping said lid at an intermediate position, and protective screen means on said frame about said lid and electric heating means when the same are in said upper position.

2. The structure of claim 1 in which said selectively traveling means is operative to stop said electric heating means at an intermediate position during upward travel thereof wherein said electric heating means are almost clear of said ladle so as to minimize thermal shock.

3. The structure of claim 2 in which said selectively traveling means is operative to stop said electric heating means are just slightly above said ladle to permit further adjustment of ladle position on said base.

4. The structure of claim 1 in which said selectively traveling means includes a pair of axially aligned fluid pressure cylinders of different length whereby energizing the shorter of said cylinder pair upon initial downward movement of said lid moves the said electric heating means to a position just clearing the lip of said ladle to permit ladle repositioning and the energizing of the shorter of said cylinder pair upon initial upward movement positions said electric heating means in slight overlapping relation with said ladle lip to avoid thermal shock.

5. The structure of claim 1 in which said base is horizontally swingable on said frame, and latch means on said frame for releasably latching said base in position under said electric heating means.

6. The structure of claim 1 in which lock means are provided on said arm and base to immobilize said base relative to said arm when said electric heating means are positioned in a ladle on said base.

7. The structure of claim 6 in which said arm is equipped with a depending spear and said base is equipped with an up-standing V-shaped socket for receipt of said spear whereby said arm is constrained against lateral movement relative to said base when said electric heating means are positioned in a ladle on said base.

8. The structure of claim 7 in which said spear depends further than said electric heating means to assure lateral constraint of said arm before entry of said electric heating means into a ladle.

9. The structure of claim 1 in which said arm is equipped with an upstanding bracket providing an electrical terminal coupling for said electric power means whereby a plurality of electrical heaters each equipped with similar length leads can be mounted on said lid to facilitate removal and replacement.

10. The structure of claim 9 in which said arm is equipped with a free end spaced from said carriage, said free end providing three generally-equally spaced-apart points for support of said lid.

11. The structure of claim 10 in which chains are interposed between said arm and lid for supporting said lid for adjustable engagement with the lip of a ladle supported on said base and to seat itself firmly thereon.

12. The structure of claim 1 in which said arm is equipped with a free end spaced from said carriage, said free end being equipped with three generally equally spaced apart chain means for adjustably supporting said lid.

13. The structure of claim 1 in which said screen means are generally arcuate to permit swinging movement of an upstanding handle on said ladle.

14. The structure of claim 1 in which said base is equipped with upstanding ribs for support of a ladle.

15. Electric heating apparatus for a ladle comprising a frame providing base for a ladle to be preheated and a vertically extending post positioned adjacent said base means, a carriage on said post carrying an arm horizontally extending therefrom, a lid on said arm spaced from said carriage and adapted to close a ladle on said pedestal means, said lid being equipped with electric heating means adapted to depend inside said ladle when said lid structure is in closing relationship therewith, electric power means coupled to said electric heating means to energize the same, and a pair of axially-aligned fluid pressure cylinders of different length mounted on said frame for selectively traveling said lid between upper and lower positions with two positions intermediate thereof.

16. The structure of claim 15 in which control means for said cylinders and said electric heating means are provided remote from said frame.

17. The structure of claim 15 in which said base is horizontally swingably mounted on said post.

18. The structure of claim 17 in which a plurality of protective means are provided on said frame for immobilizing said base relative to said arm when said electric heating means are positioned inside a ladle on said base.

19. The structure of claim 18 in which said protective means include a latch for said ladle, and cooperative locking means on said arm and base.

20. The structure of claim 19 in which said protective means includes limit switch means on said post for preventing actuation of said cylinders unless said base is in predetermined position.

21. The structure of claim 15 in which said electric heating means includes a silicon carbide electric heater.

22. The structure of claim 21 in which control means are operably associated with said cylinders and electric power means to delay the complete withdrawal of said electric heating means from a ladle on said base and maintain the said electric heating means in an intermediate position to avoid thermal shock.

* * * * *